US009458839B2

(12) United States Patent
Schmitt et al.

(10) Patent No.: US 9,458,839 B2
(45) Date of Patent: Oct. 4, 2016

(54) HYDROSTATIC MACHINE, IN PARTICULAR AXIAL PISTON MACHINE

(75) Inventors: Joachim Schmitt, Horb (DE); Peter Krause, Herrenberg (DE); Ulrich Bittner, Rottenburg (DE); Josef Kopecki, Herrenberg (DE); David Breuer, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 351 days.

(21) Appl. No.: 13/979,514

(22) PCT Filed: Jan. 18, 2012

(86) PCT No.: PCT/EP2012/000194

§ 371 (c)(1),
(2), (4) Date: Sep. 19, 2013

(87) PCT Pub. No.: WO2012/100919

PCT Pub. Date: Aug. 2, 2012

(65) Prior Publication Data

US 2014/0003971 A1 Jan. 2, 2014

(30) Foreign Application Priority Data

Jan. 27, 2011 (DE) ..... 10 2011 009 537

(51) Int. Cl.

| | |
|---|---|
| ***F04B 1/12*** | (2006.01) |
| ***F04B 27/06*** | (2006.01) |
| ***F04B 1/20*** | (2006.01) |
| ***F01B 3/00*** | (2006.01) |

(Continued)

(52) U.S. Cl.

CPC ..... *F04B 1/128* (2013.01); *F01B 3/0026* (2013.01); *F04B 1/20* (2013.01); *F04B 1/2064* (2013.01);

(Continued)

(58) Field of Classification Search

CPC ..... F04B 1/2078; F04B 1/2064; F04B 1/20; F04B 39/12; F04B 27/00612; F04B 27/06

USPC ..... 417/269–271; 91/499, 505

See application file for complete search history.

(56) References Cited

U.S. PATENT DOCUMENTS 3,062,434 A * 11/1962 Elwell ..... 417/271
3,199,378 A * 8/1965 Badalini ..... 74/732.1

(Continued)

FOREIGN PATENT DOCUMENTS

DE 1 915 735 10/1969
DE 42 03 619 A1 8/1993

(Continued)

OTHER PUBLICATIONS

International Search Report corresponding to PCT Application No. PCT/EP2012/000194, mailed Jan. 23, 2013 (German and English language document) (8 pages).

*Primary Examiner* — Charles Freay
*Assistant Examiner* — Christopher Bobish
(74) *Attorney, Agent, or Firm* — Maginot, Moore & Beck LLP

(57) ABSTRACT

A hydrostatic machine includes a housing and a drive shaft. The housing has an inner housing part, configured to receive a force flow, an outer housing part, configured to seal and damp, and a housing floor. The drive shaft is configured, on an input side, to pass coaxially through the housing floor and is configured, on an output side, to pass coaxially through a swash plate. The drive shaft is connected to a cylinder drum in a rotationally fixed manner. The hydrostatic machine is configured in a weight-saving manner and is configured such that propagation of vibrations in the hydrostatic machine, and noise generation therefrom, are reduced. To this end, the drive shaft is further configured to pass only partially through the inner housing part and is rotatably mounted in the housing floor and the inner housing part.

17 Claims, 3 Drawing Sheets

(51) Int. Cl.
*F04B 39/00* (2006.01)
*F04B 39/12* (2006.01)
*F04B 53/00* (2006.01)

(52) U.S. Cl.
CPC ..... *F04B 1/2078* (2013.01); *F04B 27/0612* (2013.01); *F04B 39/0044* (2013.01); *F04B 39/121* (2013.01); *F04B 53/003* (2013.01)

(56) References Cited

U.S. PATENT DOCUMENTS 5,332,371 A * 7/1994 Dantlgraber et al. ..... 417/363
5,752,428 A * 5/1998 Jepsen ..... 91/499
2002/0041811 A1* 4/2002 Yokomachi et al. ..... 417/269
2002/0114709 A1* 8/2002 Murase et al. ..... 417/269
2002/0114710 A1* 8/2002 Yokomachi et al. ..... 417/269
2002/0127118 A1* 9/2002 Yokomachi et al. ..... 417/269
2002/0146328 A1* 10/2002 Yokomachi et al. ..... 417/307

FOREIGN PATENT DOCUMENTS

EP 0 090 953 A2 3/1983
EP 1 092 870 A2 4/2001
GB 1 101 631 1/1968

* cited by examiner

HYDROSTATIC MACHINE, IN PARTICULAR AXIAL PISTON MACHINE

This application is a 35 U.S.C. §371 National Stage Application of PCT/EP2012/000194, filed on Jan. 18, 2012, which claims the benefit of priority to Serial No. DE 10 2011 009 537.3, filed on Jan. 27, 2011 in Germany, the disclosures of which are incorporated herein by reference in their entirety.

The disclosure proceeds from a hydrostatic machine, in particular an axial piston machine, which has the features described below.

BACKGROUND

Known axial piston machines of this type have a drive shaft which is mounted rotatably in a housing, which penetrates a swash plate on the drive side, to which a cylinder barrel is connected via a driving region in a rotationally fixed and axially displaceable manner, and which coaxially penetrates a connection plate which is fixed to the housing. The cylinder barrel has displacers which can be displaced longitudinally in cylinder bores which are arranged on a pitch circle. The swash plate is mounted in the housing interior. During operation, internal dynamic forces are produced which are caused, above all, by the superimposition of the pressure forces which occur on the individual displacers and vary over time. Since the housing lies in the force flow of the internal dynamic forces, the housing is excited to oscillate, which results in sound emission and solid-borne sound transmission to the connection plate, to pipe or hose lines and other structures which are coupled to the housing. Since the force flow is guided completely via the housing, the housing has to be dimensioned correspondingly, as a result of which the weight and material expenditure are increased. Since a lower weight limit is already predefined by the surface and minimum wall thickness of the production process in the case of housings, in particular housings made by sand casting, and the requirements are tending increasingly toward an overall configuration which saves installation space with a weight which is as low as possible, there is scarcely any scope for additional mass for acoustic measures. In addition, known measures for noise reduction do not reduce the oscillation excitation, but rather merely impede the readiness of the housing to oscillate.

The disclosure is therefore based on the object of providing a hydrostatic machine, in particular an axial piston machine of the type mentioned at the outset, which is of weight-saving configuration and in which the propagation of oscillations and, resulting therefrom, the generation of noise are reduced.

SUMMARY

This object is achieved for a hydrostatic machine, in particular an axial piston machine, having the features described below by way of an additional configuration with the features from the description below.

In the case of a hydrostatic machine according to the disclosure, in particular an axial piston machine, the drive shaft penetrates only an inner housing part at least partially and is mounted rotatably in a housing bottom and in the inner housing part. The inner housing part and the housing bottom are a constituent part of a housing which additionally has an outer housing part which is spaced apart from the inner housing part. For this reason, only the inner housing part and the housing bottom lie in the force flow of the internal dynamic forces here. As a result of the housing construction and the mounting of the drive shaft in the inner housing part and in the housing bottom, the inclination to oscillate and therefore the solid-borne sound transmission to the connection plate and to pipe or hose lines and the direct noise emission are reduced. The housing bottom additionally represents a blocking mass for solid-borne sound decoupling from the connection region. Since the dynamic forces are decoupled from the outer housing part as a result of the housing parts being spaced apart, said outer housing part is virtually free from excitation and only has a sealing function. As a result, new possibilities are opened with regard to the material selection of the housing parts. Since the sealing function is realized by the outer housing part, the inner housing part can be configured as an open structure and therefore with a reduced weight. As a result, the drive shaft can also penetrate the inner housing part completely, which has an advantageous effect on the function and configuration of the shaft mounting in the inner housing wall. Particular material requirements for the inner housing part are high strength with low weight and compact configuration.

Advantageous refinements of a hydrostatic machine according to the disclosure, in particular of an axial piston machine, are specified in the description below.

According to one particularly advantageous refinement of the present disclosure, the housing parts are fixed spaced apart from one another on an upper side of the housing bottom. As a result, the housing bottom acts as a blocking mass with regard to the introduction of solid-borne sound into the following structure. The outer housing part terminates in a tight manner with the housing bottom and is decoupled acoustically from the inner housing part. The outer housing can be connected without special decoupling measures to the housing bottom, for example by way of a direct screwed connection. However, a connection is also possible with an additional decoupling measure, for example in the form of an elastomer.

It proves extremely advantageous that the outer housing part is composed of a vibration-damping material with a low weight, in particular is composed at least partially of plastic. Since the outer housing part only has a sealing function, there are many possibilities for the material selection. Composite materials (GRP/CRP) can also be used as material for the outer housing part. It is essential here that the material has a damping effect on the propagation of oscillations and achieves sealing of the housing interior. Resulting herefrom, the outer housing part can additionally be selected with regard to reducing the weight and installation space.

Particular advantages result with regard to the construction and the housing weight if the inner housing part is a strut-shaped loadbearing frame. The production of oscillations is reduced by the compact configuration of the loadbearing frame. As a result, the requirements made of the inner housing in relation to the weight and the complexity are reduced. If the struts are arranged in a lattice-like manner, the inner housing is of particularly stable configuration. The strut-shaped loadbearing frame can also correspond to a tie rod in terms of effect and configuration.

The inner housing part is advantageously a frame structure with machined bearing tracks for the swash plate and a machined bearing for the drive shaft. In addition to the considerable noise reduction, an embodiment of this type of the inner housing part has an advantageous effect on the production and the assembly.

If the frame structure for the swash plate has a bearing track on a high pressure side and a bearing track on a low pressure side which are both accessible by a cutout on the low pressure side or on the high pressure side, the production process is simplified with regard to the bearing track production. A tool axis can therefore be oriented parallel to the pivot axis and the bearing tracks can be produced with high production accuracy in a clamping means.

It proves extremely advantageous that the frame structure on the high pressure side has reinforcements in the form of ribs or braces. The different loading on the high and low pressure side is taken into consideration by the asymmetrical configuration of the loadbearing structure. The loadbearing structure is detuned as a consequence of the high pressure-side reinforcement, with the result that a common resonance on the high and low pressure side can be avoided. A reinforcement on the low pressure side is less favorable, but is also possible.

The frame structure preferably has at least one cross-sectional step, for example at the transition of the frame structure to the bearing tracks. A cross-sectional step impedes the transmission of oscillations. During the conversion into bending waves and vice versa, longitudinal waves are interrupted and lose oscillation energy.

If at least one compliance is introduced into the inner housing part, jolt-like forces of the engine can be cushioned and the swash plate mounting can bear more tightly. In the case of shaft tilting, the risk of edge loading is avoided by way of a compliant holder of the shaft bearing seat on the swash plate side.

According to one particularly advantageous refinement of the present disclosure, at least one oscillatory system for absorbing oscillation energy is integrated into the inner housing part, in particular on the low pressure side.

The different embodiments of the inner housing can be in one piece or in multiple pieces. In particular, if the pivot cradle is mounted in a bearing block, the latter can be inserted into the inner housing.

The disclosure is suitable for a multiplicity of hydraulic applications by virtue of the fact that the hydrostatic piston machine is an axial piston machine, having a housing which comprises an inner housing part, an outer housing part and a housing bottom, and having a drive shaft which penetrates the housing bottom coaxially on the drive side, is connected fixedly to a cylinder barrel so as to rotate with it, and penetrates a swash plate on the drive output side. The swash plate can be of adjustable or non-adjustable configuration. This opens up a wide field of application and also the mass market for the hydrostatic piston machine, the stated refinement in accordance with description depending to a very pronounced extent on an axial piston machine, the weight of which is highly reduced and which is optimized with regard to the production of noise.

BRIEF DESCRIPTION OF THE DRAWINGS

Exemplary embodiments of a hydrostatic piston machine according to the disclosure, in particular of an axial piston machine, are shown in the drawings. The disclosure will now be explained in greater detail using the figures of said drawings, in which.

DETAILED DESCRIPTION

Figure 1:
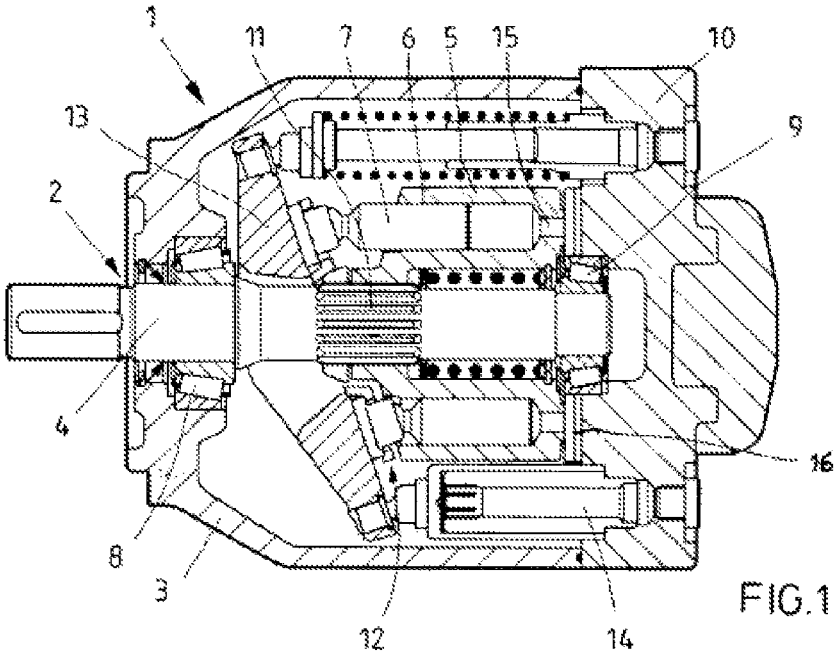
FIG. 1 shows a longitudinal section through an axial piston machine of swash plate configuration in accordance with the prior art.

The axial piston machine 1 of swash plate configuration shown in FIG. 1 has an engine 2 which is arranged in a housing 3.

As essential components, the engine 2 comprises a drive shaft 4 which is mounted rotatably via two antifriction bearings 8, 9, a cylinder barrel 5 which has axially running cylinder bores 6 which are arranged on a pitch circle with pistons 7 which can be displaced longitudinally therein and is connected in a rotationally fixed and axially displaceable manner to the drive shaft 4 via a driving region 11 in the form of a cylinder toothing system, and a connection plate 10 which is fixed to the housing and is penetrated coaxially by the drive shaft 4.

The pistons 7 which are guided longitudinally displaceably in the cylinder bores 6 are of cylindrical configuration. Those ends of the pistons 7 which are remote from the cylinder barrel are supported in each case via a joint 12 on a swash plate 13.

The swash plate 13 is penetrated by the drive shaft 4. This figure does not show that the pivot cradle which is mounted as pivotable is configured with circular segment-shaped bearing tracks; it is arranged in the respective pivoting position such that it can be set by an adjusting apparatus 14.

The cylinder bores 6 open via cylinder kidneys 15 into a cylinder base face which cooperates with a control face of a non-rotating control plate 16 for the purpose of feeding in and discharging the pressure medium.

During a rotation of the drive shaft 4, the cylinder barrel 5 including the pistons 7 also rotates on account of the rotationally fixed connection. If the swash plate 13 is pivoted into an oblique position with respect to the cylinder barrel 5 by actuation of the actuating apparatus 14, the pistons 7 perform reciprocating movements. During one complete rotation of the cylinder barrel 5, each piston 7 runs through a suction and a compression stroke, corresponding oil streams being produced, the feeding and discharging of which take place via the cylinder kidneys 15, control plate 16 and pressure and suction channel (not shown) in the connection plate 10.

Figure 2:
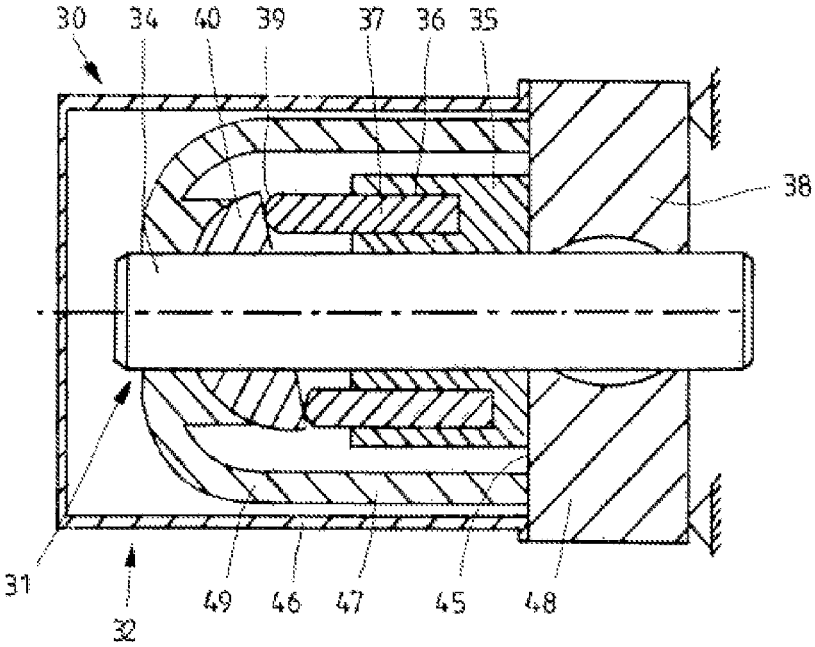
FIG. 2 shows a simplified longitudinal section through an axial piston machine according to the disclosure of swash plate configuration.

The axial piston machine 30 according to the disclosure of swash plate configuration which is shown in FIG. 2 has an engine 31 which is arranged in a housing 32. As essential components, the engine 31 comprises a rotatably mounted drive shaft 34, a cylinder barrel 35 which has axially running cylinder bores 36 which are arranged on a pitch circle with pistons 37 which can be displaced longitudinally therein, and which is connected in a rotationally fixed and axially displaceable manner to the drive shaft 34, and a connection plate 38 which is fixed to the housing and is penetrated coaxially by the drive shaft 34. The pistons 37 which are guided longitudinally displaceably in the cylinder bores 36 are of cylindrical configuration. Those ends 39 of the pistons 37 which are remote from the cylinder barrel are supported in each case on a swash plate 40.

The swash plate 40 is penetrated by the drive shaft 34. The swash plate 40, or else pivot cradle, which is mounted as pivotable is configured with a circular segment-shaped cross section.

The housing 32 comprises an outer housing part 46, an inner housing part 47 and a housing bottom 48. The housing bottom 48 corresponds to the connection plate 38. The inner housing part 47 is arranged spaced apart from the outer housing part 46 and both housing parts 46 and 47 are fixed spaced apart from one another on a surface 45 of the housing bottom 48.

The drive shaft 34 penetrates only the inner housing part 47 and is mounted rotatably in the housing bottom 48 and in the inner housing part 47. The inner housing part 47 is configured as a strut-shaped loadbearing frame 49. Since the sealing function for the inner housing part 47 is dispensed with, the loadbearing frame 49 can be configured as an open structure which results in a compact and simple configuration with a reduced weight. Owing to the housing construction and to the mounting of the drive shaft 34 in the loadbearing frame 49 and in the housing bottom 48, the inclination to oscillate and therefore the sound emission and solid-borne sound transmission to the connection plate 38 and to pipe or hose lines are reduced, and only the inner housing part 47 lies in the force flow of the internal dynamic forces. The housing bottom 48 additionally represents a blocking mass for decoupling the solid-borne sound from the connection region. The outer housing part 46 terminates in a tight manner with the housing bottom 48 and is decoupled acoustically from the inner housing part 47. The outer housing 46 therefore remains virtually free of oscillations and only has a sealing function.

Figure 3:
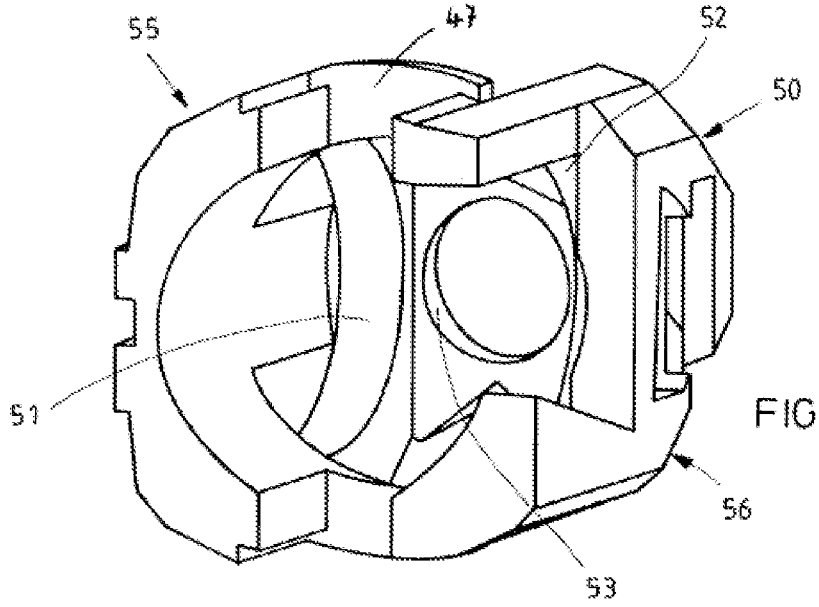
FIG. 3 shows one preferred embodiment of the inner housing as loadbearing frame construction of the axial piston machine according to the disclosure in a perspective view.

In FIG. 3, the inner housing part 47 is realized by a loadbearing frame structure 50, into which bearing tracks 51, 52 for the swash plate and a bearing 53 for the drive shaft are machined. The bearing track 51 is arranged on a high pressure side 55 of the loadbearing frame structure 50 and the bearing track 52 is arranged on a low pressure side 56 of the loadbearing frame structure 50, with the result that both bearing tracks 51, 52 are accessible from the low pressure side 56.

Said bearing tracks 51, 52 can be produced from the low pressure side 56 in a clamping means. The different loading on the high and low pressure side 55, 56 is taken into consideration by an asymmetrical configuration of the loadbearing frame structure 50.

Figure 4:
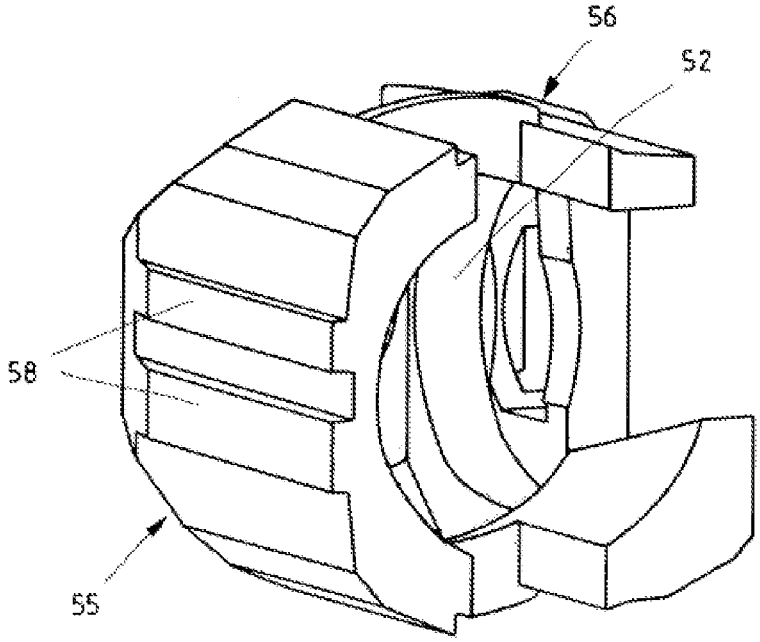
FIG. 4 shows the loadbearing frame construction according to FIG. 3, rotated by 90°.

In FIG. 4, the perspective view of the high pressure side 55 of the loadbearing frame 50 according to FIG. 3 is depicted. It has reinforcements in the form of longitudinal ribs 58.

As a consequence of the high pressure-side reinforcement 58 and the asymmetrical configuration, the loadbearing frame structure 50 is detuned, that is to say a common resonance on the high and low pressure side 55, 56 is avoided. As a result, the inclination to oscillate of the loadbearing frame 50 is reduced.

Figure 5:
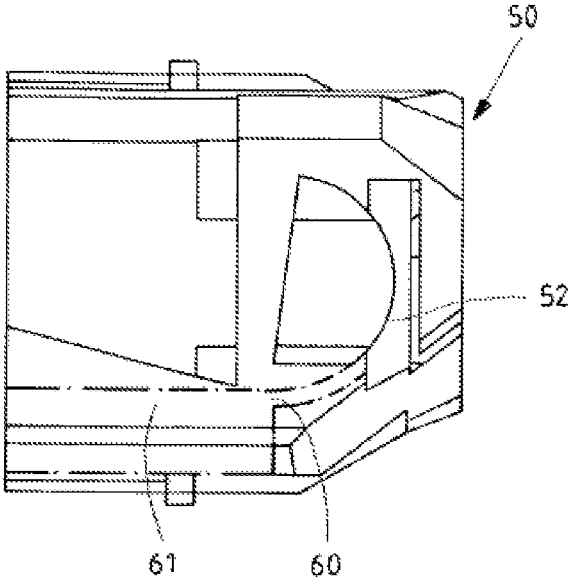
FIG. 5 shows a second embodiment of the loadbearing frame construction according to FIG. 3.

FIG. 5 shows a part view of a further embodiment of the loadbearing frame 50 which is configured with a cross-sectional step 60 at the transition from a longitudinal web 61 to the bearing track 52. As a result of the cross-sectional step arrangement between the longitudinal web 61 and the bearing track 52, the forwarding of oscillations is impeded. The conversion of longitudinal waves into bending waves and vice versa is impeded by the cross-sectional step 60. As a result, the oscillation excitation is reduced greatly. Cross-sectional steps can be introduced at all transitions to the bearing tracks 51, 52.

Figure 6:
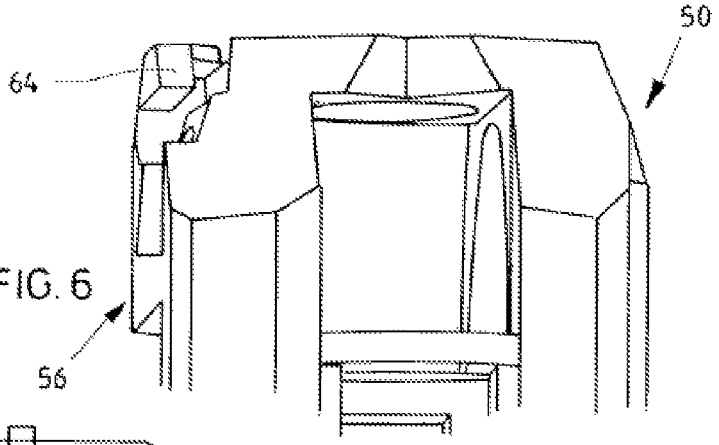
FIG. 6 shows a third embodiment of the loadbearing frame construction according to FIG. 3.

FIG. 6 shows a part view of a further embodiment of the loadbearing frame 50 which has an oscillatory system in the form of a damper mass 64. The damper mass 64 is arranged so as to swing freely on the low pressure side 56.

One or more oscillatory systems 64 can be integrated into the loadbearing frame 50. They absorb the oscillation energy, by being tuned to the nominal rotational speed or over a broad spectrum to a rotational speed range. The damper mass 64 can also be configured as a tongue plate, beam or as a compliantly suspended mass from a part region of the inner housing, which part region is weakened by grooves or apertures. The damper mass 64 can be damped additionally by maintenance of a small gap size between the damper 64 and the loadbearing frame 50 in conjunction with a housing oil, by filling of the intermediate space between the damper mass and inner housing with an elastic damping element, by an adaptive adaptation of the damper frequency to the respective operating point or by active or passive measures.

Figure 7:
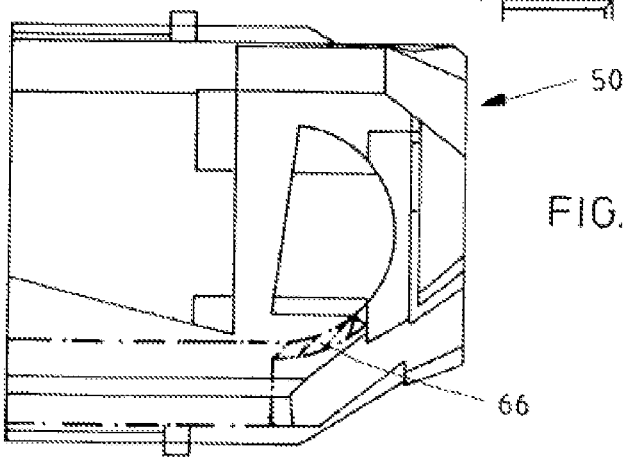
FIG. 7 shows a fourth embodiment of the loadbearing frame construction according to FIG. 3.

A compliance 66 is introduced in the further embodiment of the loadbearing frame 50 shown in FIG. 7.

As a result, jolt-like forces of the engine are cushioned and the swash plate mounting can bear more tightly. In the case of shaft tilting, the risk of edge loading is avoided by way of a compliant holder of the shaft bearing seat on the swash plate side. A plurality of positions are possible for the introduction of compliances.

The embodiments of FIGS. 5, 6 and 7 can be combined in order to increase the noise reduction.

The invention claimed is:

1. A hydrostatic piston machine, comprising:

a housing including an inner housing part, an outer housing part, and a housing bottom;

a cylinder barrel;

a swash plate; and a drive shaft connected fixedly to the cylinder barrel so as to rotate with the cylinder barrel, a drive side of the drive shaft penetrating through the housing bottom coaxially, and an output side of the drive shaft penetrating through the swash plate, wherein:

the drive shaft penetrates through the inner housing part at least partially;

the drive shaft does not penetrate the outer housing part; and the drive shaft is mounted rotatably in the housing bottom and in the inner housing part;

the inner housing part is a frame structure with machined bearing tracks configured for the swash plate and a machined bearing configured for the drive shaft;

the frame structure has a first machined bearing track of the machined bearing tracks on a high pressure side and a second machined bearing track of the machined bearing tracks on a low pressure side, and both the first and the second machined bearing tracks are configured to be accessed by a cutout on one of the low pressure side and the high pressure side.

2. The hydrostatic machine as claimed in claim 1, wherein:

the outer housing part is arranged spaced apart from the inner housing part, and the inner housing part and the outer housing part are connected to the housing bottom.

3. The hydrostatic machine as claimed in claim 1, wherein the housing bottom is configured to form a blocking mass.

4. The hydrostatic machine as claimed in claim 1, wherein the outer housing part is composed of an oscillation-damping material with a low weight.

5. The hydrostatic machine as claimed in claim 1, wherein the inner housing part is a strut-shaped loadbearing frame.

6. The hydrostatic machine as claimed in claim 1, wherein the frame structure has asymmetrical reinforcements configured to detune the loadbearing frame.

7. The hydrostatic machine as claimed in claim 1, wherein the frame structure has at least one cross-sectional step at a transition of the frame structure to the machined bearing tracks.

8. The hydrostatic machine as claimed in claim 1, wherein at least one compliance is introduced into the inner housing part.

9. The hydrostatic machine as claimed in claim 1, further comprising:

at least one oscillatory system that is integrated into the inner housing part, and that includes at least one damper mass configured to swing freely relative to the inner housing part to absorb oscillation energy of the hydrostatic piston machine.

10. A hydrostatic piston machine, comprising:

a housing bottom;

a drive shaft that includes:

a drive portion that penetrates through the housing bottom such that the housing bottom rotatably supports the drive portion of the drive shaft; and an output portion facing away from the drive portion;

a cylinder barrel coaxially mounted on the output portion of drive shaft so as to rotate with the drive shaft;

a swash plate coaxially mounted on the output portion of the drive shaft and configured to engage the cylinder barrel as the drive shaft rotates;

an inner housing part that is fixed to the housing bottom, that rotatably supports the output portion of the drive shaft in an unsealed fashion, and that includes a strut-shaped loadbearing frame having:

machined bearing tracks configured to engage the swash plate;

a machined bearing configured to rotationally support the drive shaft; and at least one asymmetrical reinforcement configured to detune the loadbearing frame such that a high pressure side of the loadbearing frame has a different resonance than a low pressure side of the loadbearing frame; and an outer housing part that surrounds the output portion of the drive shaft, the cylinder barrel, the swash plate, and the inner housing part to define a housing interior, the outer housing part spaced apart from the inner housing part, and the outer housing part fixed to the housing bottom in a sealed fashion to seal off the housing interior.

11. The hydrostatic piston machine as claimed in claim 10, wherein the outer housing part is configured to be acoustically decoupled from the inner housing part.

12. The hydrostatic piston machine as claimed in claim 10, wherein the housing bottom defines a blocking mass configured to decouple solid-borne sound of the housing bottom from a structure connected to the housing bottom.

13. The hydrostatic piston machine as claimed in claim 10, wherein the outer housing part is formed from an oscillation-damping material that has a low weight relative to a weight of a material of the inner housing part.

14. The hydrostatic piston machine as claimed in claim 10, wherein:

the frame has a first machined bearing track of the machined bearing tracks on a high pressure side and a second machined bearing track of the machined bearing tracks on a low pressure side, and the frame defines a cutout on either the low pressure side or the high pressure side that enables access to both the first and second machined bearing tracks.

15. The hydrostatic piston machine as claimed in claim 10, wherein the frame further has at least one cross-sectional step at a transition of the frame structure to the machined bearing tracks.

16. The hydrostatic piston machine as claimed in claim 10, wherein the inner housing part includes at least one compliant member configured to cushion forces acting on at least one of the drive shaft, swash plate, and housing bottom.

17. The hydrostatic piston machine as claimed in claim 10, further comprising:

at least one oscillatory system that is integrated into the inner housing part, and that includes at least one damper mass configured to swing freely relative to the inner housing part to absorb oscillation energy of the hydrostatic piston machine.

* * * * *